United States Patent [19]

Hiramatsu et al.

[11] 4,308,840

[45] Jan. 5, 1982

[54] DEVICE FOR PREVENTING EVAPORATIVE FUEL LOSS

[75] Inventors: Eizi Hiramatsu, Aichi; Yasushi Nakagawa; Hidenori Sato, both of Nagoya, Japan

[73] Assignees: Toyota Jidosha Kogyo Kabushiki Kaisha, Toyota; Nippon Denso Kabushiki Kaisha, Kariya, both of Japan

[21] Appl. No.: 71,769

[22] Filed: Aug. 31, 1979

[30] Foreign Application Priority Data

Feb. 9, 1979 [JP] Japan ..... 54/13247

[51] Int. Cl.[3] ..... F02M 37/00

[52] U.S. Cl. ..... 123/519; 55/387; 55/485

[58] Field of Search ..... 123/519, 518, 517, 516; 55/387, 485, 385 B, 385 C; 210/188, 189

[56] References Cited

U.S. PATENT DOCUMENTS 4,058,380 11/1977 King ..... 123/519
4,173,207 11/1979 Hiramatsu ..... 123/519
4,203,401 5/1980 Kingsley et al. ..... 55/387

FOREIGN PATENT DOCUMENTS 47-4844 2/1972 Japan ..... 123/519
2003743 3/1979 United Kingdom ..... 55/387

*Primary Examiner*—Ira S. Lazarus
*Assistant Examiner*—Magdalen Moy
*Attorney, Agent, or Firm*—Armstrong, Nikaido, Marmelstein & Kubovcik

[57] ABSTRACT

A device for preventing evaporative fuel loss comprising a casing which accommodates fuel gas absorbing agents. The casing is divided into three slender compartments by means of two partitions. A flow-in chamber is disposed at the entrance of the first compartment and is communicated with a fuel tank. Two dispersing chambers communicate the outlet of the first compartment and the inlet of the second compartment, and the outlet of the second compartment and the inlet of the third compartment, respectively. An atmospheric chamber is disposed at the exit of the third compartment and has an atmospheric port for flowing in purge air and for discharging filtered and clean air.

4 Claims, 6 Drawing Figures

DEVICE FOR PREVENTING EVAPORATIVE FUEL LOSS

BRIEF DESCRIPTION OF THE INVENTION

This invention relates to a device for preventing evaporative fuel loss, more specifically, a device for preventing evaporative fuel loss comprising a casing which accomodates fuel gas absorbing agents therein and for use in an vehicle with an internal combustion engine, which will be referred as a vehicle hereinafter, especially, in an automobile.

BACKGROUND OF THE INVENTION

If fuel evaporation from a fuel tank of an automobile and/or a combustible gas mixture preparing device, such as a carburetor, is emitted into the atmosphere, air pollution is caused due to hydrocarbons (HC) contained in the fuel. Devices are known which are provided with a casing accomodating fuel gas absorbing agents therein and which prevent air pollution due to evaporated fuel as well as evaporative fuel loss.

Such a device for preventing evaporative fuel loss is communicated with a fuel tank and/or a carburetor of a vehicle so that fuel, which is evaporated when the temperature of the fuel tank or the carburetor rises, is absorbed in the fuel gas absorbing agents. On the other hand when the engine of the vehicle is started, the fuel, which has been absorbed in the fuel gas absorbing agents, is purged by air introduced through an atmospheric port formed at the bottom of the casing, and it, together with the atmospheric air, is led into combustion chambers of the engine through the intake system of the engine and is burnt there. As a result, emission of hydrocarbons into the atmosphere is prevented and air pollution caused thereby is thus prevented.

It is preferable that a device for preventing evaporative fuel loss, especially for use on an automobile, can absorb a large amount of fuel while the volume thereof is small, because the device can readily be installed on the vehicle. On the other hand, to increase the so called utilizing efficiency of fuel gas absorbing agents in the device for preventing evaporative fuel loss, it is desirable that a large amount of air supplied from an evaporative fuel source and containing evaporated fuel therein be in contact with a large amount of fuel gas absorbing agents, so that the evaporated fuel is effectively absorbed in the fuel gas absorbing agents.

Based on the results obtained from various tests conducted by the inventors of the present invention, the inventors confirmed that the utilizing efficiency could be increased when a casing of a device for preventing evaporative fuel loss was formed in a straight slender shape. However, such a device having a straight slender shape was difficult to install on a vehicle. To easily install the device on a vehicle, the slender shaped casing was serpentined so that the outer shape of the entire device was similar to that of the conventionally known device. However, such a device wherein a slender casing was serpentined did not have such a high utilizing efficiency as a device having a straight slender casing did.

The inventors believe that the phenomenon mentioned above is caused by a fact that, when a serpentined casing is used, air containing evaporated fuel may substantially flow along a path connecting the edges of the serpentined casing, which path is the shortest air flow path. As a result, only a part of fuel gas absorbing agents in the slender casing can be utilized for effectively absorbing fuel.

SUMMARY OF THE INVENTION

The pincipal object of the present invention is to provide a novel construction of a device for preventing evaporative fuel loss, wherein air containing evaporated fuel is prevented from flowing along the shortest path and almost all fuel gas absorbing agents are utilized effectively for increasing the utilizing efficiency.

According to the present invention a device for preventing evaporative fuel loss comprising a casing which accomodates fuel gas absorbing agents therein is provided. The device is characterized in that the casing is divided into a plurality of compartments having absorbing agent layer therein by means of at least one partition which extends along the axis of the casing. The device is further characterized in that a flow-in chamber which is capable of being communicated with a fuel evaporative source is disposed at the entrance of a first compartment. The device is still further characterized in that an atmospheric chamber is disposed at the exit of the last compartment and is communicated with the outside of the casing via an atmospheric port. The device is still further characterized in that at least one dispersing chamber communicates an inlet of a compartment with an outlet of another compartment which is adjacent to the former compartment.

According to the present invention, a casing is separated into a plurality of compartments having fuel gas absorbing agent layers therein, and two adjacent compartments are communicated with each other by means of a dispersing chamber. As a result, air containing evaporated fuel, which is introduced through the flow-in chamber and is flowed out through the atmospheric chamber, is in contact with a large amount of fuel gas absorbing agents while it flows along a long serpentined path. In addition, a flow-in chamber, an atmospheric chamber and one or more dispersing chambers disposed at the entrance or the exit of the compartments, permit the air containing evaporated fuel to be dispersed within the chambers, and to uniformly pass through the entire compartments and not concentrate at particular portions within the compartments.

To increase the uniform flow within the compartments, it is preferable that the areas of the flow-in and atmospheric chambers, which areas are cross sectioned by a plane perpendicular to the axis of the casing, be substantially equal to the areas of the first and last compartments, which areas are also cross sectioned by a plane perpendicular to the axis of the casing, respectively. It is also preferable that the area of the dispersing chamber, which area is cross sectioned by a plane perpendicular to the axis of the casing, be substantially equal to or more than the sum of the areas of the inlet and outlet of the compartments which are adjacent to each other and are communicated with each other by the dispersing chamber.

BRIEF DESCRIPTION OF THE DRAWINGS

Some embodiments of the present invention will now be explained, with reference to the accmpanying drawings, wherein.

DETAILED DESCRIPTION OF THE INVENTION

Figure 2:
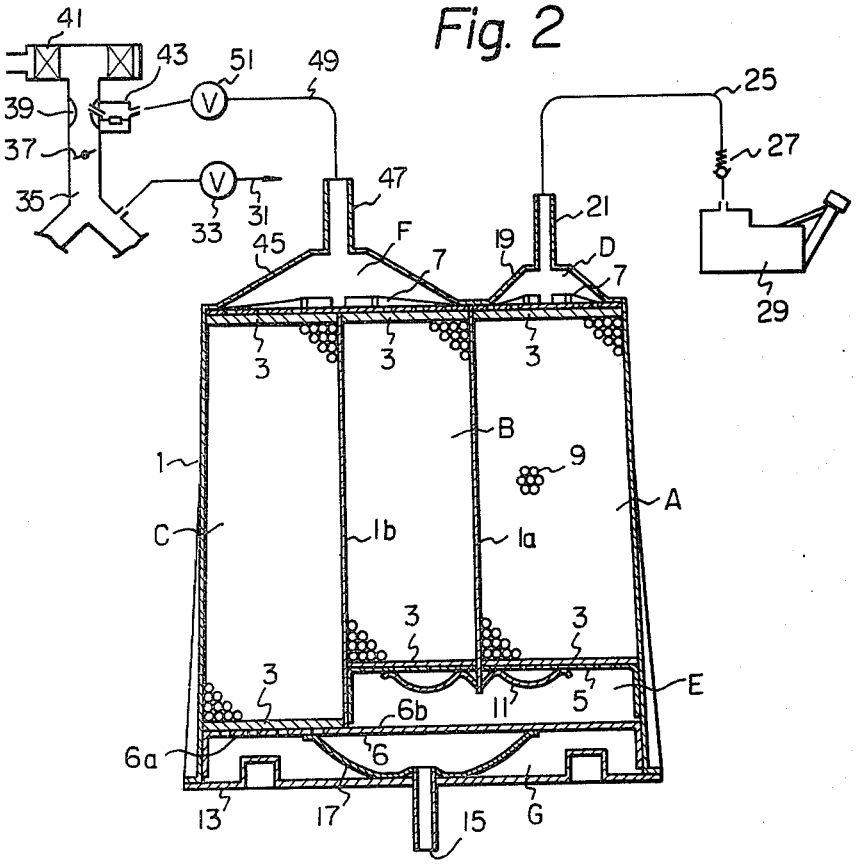
FIG. 2 is a cross sectional view taken along line II—II illustrated in FIG. 1.

Referring to FIG. 2 first, the inside of the canister casing 1 is divided into three compartments A, B and C having fuel gas absorbing agent layers therein, by means of two partitions 1*a* and 1*b* extending vertically. Although two partitions 1*a* and 1*b* are illustrated in FIG. 2, the number of partitions may be one or more than two. As a result, the casing 1 may be divided into a plurality of compartments, the number of which depends on the number of partitions. At the tops and the bottoms of the compartments A, B and C, filters 3 made of a foam material, such as urethane foam, or an unwoven fabric, which is preferably a blend of synthetic fibers, such as nylon or polyester, and rayon, are disposed. In addition, punching plates 5 and 6 made of a metal or a plastic are disposed at the bottoms, and punching plates 7 provided with vapor guides are disposed on the tops. Fuel gas absorbing agents 9, which are particles of activated charcoal, are filled in the spaces between the upper and lower filters 3. A plate spring 11, disposed at the lower end of the partition 1*a* located between the compartments A and B, urges upwards a punching plate 5 together with the filters 3, which plate is formed in a dish shape and is disposed at the lower end of the compartments A and B. A plate 6 has a plurality of small holes at the portion 6*a* facing the bottom of the compartment C, but has no holes at the portions 6*b* facing the bottoms of the compartments A and B. A space surrounded by the portion 6*b*, having no holes, and the punching plate 5 forms a first dispersing chamber E. The dispersing chamber E communicates the two compartments A and B.

A lower case 13 is sealingly secured to the lower end of the casing 1, and a space surrounded by the lower case 13 and the punching plate 6 forms an atmospheric chamber G. An atmospheric port 15 is projected from the lower case 13 and permits the filtered air and the atmospheric air to pass therethrough. A plate spring 17 is disposed within the atmospheric chamber G, so as to urge the punching plate 6 upwards.

Figure 3:
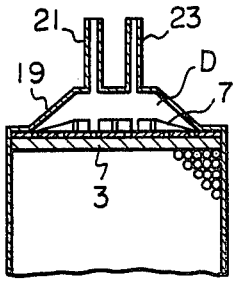
FIG. 3 is a cross sectional view taken along line III—III illustrated in FIG. 1.

An inlet case 19 having a frustopyramidal shape is sealingly secured to and surrounds the upper end of the compartment A, and a flow-in chamber D is formed at the entrance of the compartment A. As illustrated in FIG. 3, a tank port 21 and a purge port 23 are projectingly disposed on the inlet case 19. As illustrated in FIG. 2, the tank port 21 is communicated with an evaporative fuel source, such as a fuel tank 29, via a first passage 25 and a check valve 27, so that the evaporated fuel created in the fuel tank 29 is permitted to flow-in the inlet chamber D by pressing the check valve 27 when the temperature of the fuel in the fuel tank 29 is raised. The purge port 23 (FIGS. 1 and 3) is communicated with a portion of an intake system 35 (FIG. 2) of an engine, which portion is located at lower side of a throttle valve 37, via a second passage 31 and a switching valve 33. The valve 33 operates in synchronism with the operation of the engine, i.e., the valve 33 is open while engine operates and the valve 33 is closed while the engine does not operate.

The intake system 35 is communicate with an air cleaner 41 via a venture portion 39 of an carburetor, and the throttle valve 37 utilized to adjust the flow of intake air into which fuel is supplied from a float chamber 43 of the carburetor. A combustible gas mixture thus obtained is taken into combustion chambers of the engine (not shown) and is burnt there.

A dispersing chamber case 45, having a frustopyramidal shape, is sealingly secured to and surrounds the upper portions of the second and third compartments B and C, so that a second dispersing chamber F, which communicates the outlet of the second compartment B with the inlet of the third compartment C, is formed. An outer vent port 47 is projected from the dispersing chamber case 45, and it communicates the dispersing chamber F with another fuel evaporative source, for example, the float chamber 43 of the carburetor, via a switching valve 51. The switching valve 51 operates in synchronism with the operation of the engine, i.e., it opens while the engine does not operate and it closes while the engine operates. In some cases, the dispersing chamber case 45 and the flow-in case 19 may be constructed in one body.

While the engine does not operate, the switching valve 51 opens and the switching valve 33 closes. When the fuel tank 29 is heated and the vapor pressure rises, the check valve 27 is pressed and open. Accordingly, air containing vaporized fuel flows into the flow-in chamber D from the fuel tank 29 through the check valve 27 and the first passage 25, and then, flows into the first dispersing chamber E through the first compartment A. After the air is dispersed in the first dispersing chamber E and becomes uniform, through the second compartment B into the second dispersing chamber F where it is dispersed and is admixed with air which contains evaporated fuel therein from the float chamber 43 through the third passage 49. Thereafter, the air containing evaporated fuel passes through the third compartment C. In the compartments A, B and C, the evaporated fuel is abosrbed in the fuel gas absorbing agents 9, and the filtered and cleaned air is discharged from the atmospheric port 15 into the atmosphere.

While the engine operates, the switching valve 51 closes and the switching valve 33 opens. When the engine operates, an intake vacuum is created within the intake system 35. As a result, atmospheric air introduced through the atmospheric port 15 flows from the atmospheric chamber G through the compartments C, B and A, and purges the fuel which has been absorbed in the fuel gas absorbing agents 9. The purged fuel together with purge air flows through purge port 23, the second passage 31 and the switching valve 33 into the intake system 35, and the combustion chamber, where it is burnt.

Figure 1:
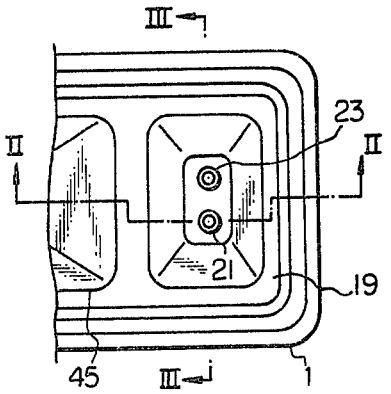
FIG. 1 is a partial plan view of a first embodiment of the present invention.
Figure 4:
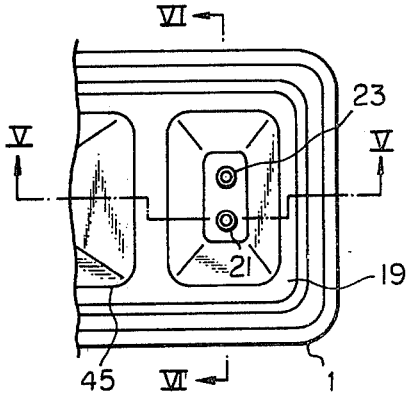
FIG. 4 is a partial plan view of a second embodiment of the present invention.
Figure 5:
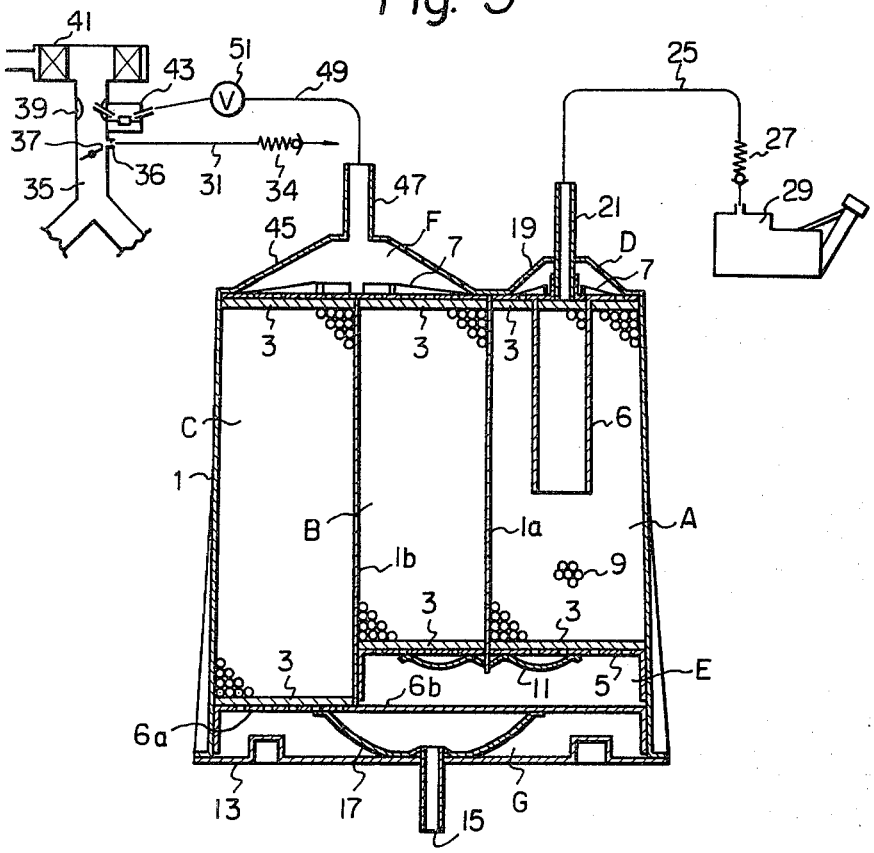
FIG. 5 is a cross sectional view taken along line V—V illustrated in FIG. 4.
Figure 6:
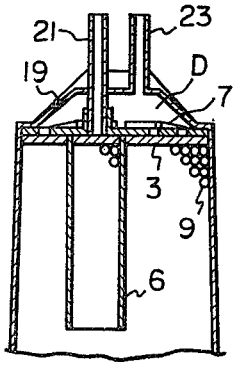
FIG. 6 is a cross sectional view taken along line VI—VI illustrated in FIG. 4.

A second embodiment of the present invention is illustrated in FIGS. 4 through 6. The second embodiment is very similar to the first embodiment, which is illustrated in FIGS. 1 through 3. Therefore, parts which are the same as those of the first embodiment are designated by the same reference numerals, and their explanation is omitted here, and only the parts which are different from those in the first embodiment will now be explained.

Referring to FIG. 5, an annular projection 6 is fixed on the punching plate 7 and extends within the compartment A. A purge port 23 (FIG. 6) is communicated with a portion upstream of the throttle valve 37 (FIG. 5) via a check valve 34, the second passage 31 and an orifice 36. In the second embodiment, the evaporated fuel is absorbed in the fuel gas absorbing agents 9 in the same manner as it is absorbed in the first embodiment. When the engine load is high and the throttle valve 37 is wide open, so that the upper edge of the throttle valve 37 is positioned higher than the portion where the orifice 36 opens, air is introduced from the atmospheric port 15 and purges fuel which has been absorbed in the fuel gas absorbing agent 9. The purged fuel flows into the combustion chambers of the engine through the intake system 35 and is burnt in the chambers. The annular projection 6 prevents the evaporated fuel from the fuel tank 27 from by-passing to the purge port 23 without the evaporated fuel being absorbed in the fuel gas absorbing agents 9.

What is claimed is:

1. A device for preventing fuel evaporative loss comprising a casing having an axis and accomodating fuel gas absorbing agents therein, said casing being divided into at least three compartments including at least a first compartment and a last compartment by means of at least two partitions which extend parallel to the axis of said casing, each compartment having absorbing agent layers therein and an inlet and an outlet, a flow-in chamber capable of being communicated with an evaporative fuel source connected to the inlet of said first compartment, an atmospheric chamber solely connected to the outlet of said last compartment and communicating with the outside of said casing via an atmospheric port, and at least two dispersing chambers, each for communicating the outlet of a compartment with the inlet of an adjacent compartment disposed adjacent to the ends of said compartments, the compartments being serially interconnected with dispersing chambers therebetween for flow of a gas in a serpentine manner.

2. A device for preventing evaporative fuel loss according to claim 1, wherein at least one of said at least two dispersing chambers is capable of being communicated with another evaporative fuel source.

3. A device for preventing evaporative fuel loss according to claim 1 or 2, wherein the areas of said flow-in and atmospheric chambers, which areas are cross sectioned by a plane perpendicular to said axis, are substantially equal to the areas of said first and last compartments, which areas are cross sectioned by a plane perpendicular to said axis, respectively, and the area of each dispersing chamber, which area is cross sectioned by a plane perpendicular to said axis, is at least substantially equal to the sum of the areas of said inlet and said outlet of said compartments which are adjacent to each other and are interconnected with each other by said dispersing chamber.

4. A devce for preventing evaporative fuel loss according to claim 3, which further comprises a purge port opened to said flow-in chamber for discharging fuel evaporation which has been absorbed in said fuel gas absorbing agent and is purged by air introduced through said atmospheric port.

* * * * *